US005529512A

United States Patent [19]

Mlyniec

[11] Patent Number: 5,529,512

[45] Date of Patent: Jun. 25, 1996

[54] CONNECTOR WITH LOW INSERTION FORCE

[75] Inventor: Kenneth P. Mlyniec, Keokuk, Iowa

[73] Assignee: Methode Electronics, Inc., Chicago, Ill.

[21] Appl. No.: 367,092

[22] Filed: Dec. 30, 1994

[51] Int. Cl.[6] ..... H01R 13/627

[52] U.S. Cl. ..... 439/352; 439/372

[58] Field of Search ..... 439/350, 352–354, 439/372, 358

[56] References Cited

U.S. PATENT DOCUMENTS 4,954,097 9/1990 Sekiguchi ..... 439/352

5,275,575 1/1994 Cahaly et al. ..... 439/352 X 5,338,227 8/1994 Nakamura ..... 439/607

5,435,748 7/1995 Abe ..... 439/372 X

*Primary Examiner*—Khiem Nguyen

*Attorney, Agent, or Firm*—David L. Newman

[57] ABSTRACT

A connector is provided particularly for use as an automobile airbag squib connector wherein locking members are provided in a resting position allowing for a low insertion force of the connector into a receptacle or airbag inflation canister. The locking members are rotated into a mated orientation upon sliding engagement of deflector pins to deflect the locking members into a locked position providing for securement of the connector within a receptacle having a retaining force of greater than thirty pounds.

9 Claims, 2 Drawing Sheets

CONNECTOR WITH LOW INSERTION FORCE

BACKGROUND OF THE INVENTION

This invention pertains to an electrical connector and in particular to a connector having a low insertion force latch.

Connectors such as automobile airbag squib connectors which utilize plastic connector housings are widely used in the automotive industry. Squib connectors are generally used to connect sensors at remote areas of the automobile to the detonation device of an airbag. Normally, three different piece-types are used in the construction of a squib connector housing including a lock section 16 shown in FIG. 1. A molded plastic airbag squib connector housing 10 is depicted with a bottom section 12, a top cover section 14 and a lock section 16. Mounted underneath the bottom section 12 is a male insert 38 and two holding pins 40. The male insert 38 is located between the two locking pin access slots 36. Conversely, the two holding pins 40 are mounted adjacent to the locking pin access slots 36 on both sides of the male insert 38. Attached along one side of the male insert 38 is a key 42. Furthermore, located on the end of the male insert 38 is a first male pin receiving port 44 and a second male pin receiving port 46.

Turning to FIG. 2, extending from the first male pin receiving port 44 to the first recess 29 is a first bore 48. Similarly, although not shown, is a second bore extending from the second male pin receiving port to the second female contact mounting recess. The bottom section 12 includes first chamber 22, second chamber 24, third chamber 26, reinforcement cavity 27, U-shaped chamber access slots 28, first recess 29, access slots 33, indented portion 66 and lip 50 of pin 40. Referring now to FIG. 3, on the end of each of the holding pins 40 is a lip 50. Each lip 50 extends outwardly and away from the male insert 38 for the purpose of retention in a mating receptacle.

Referring again to FIG. 1, the top cover section 14 has an indented portion 66 which is adapted to accommodate the lock section 16. During the molding process, the top cover section 14 is connected to the lock section 16. The lock section 16 has a base 68 and a head 70 which together form a T-shape. On the head 70 of the lock section 16 are two locking pins 72. Snapping the sections of the squib connector housing 10 together is accomplished by bending the molding runners 52 so that the top cover mounting pins 58 align with the top cover mounting slots.

The lock section 16 is utilized in order to secure the connector to a receptacle by preventing the squib connector holding pins 40 of the bottom section 12 from bending inwardly toward the male insert 38. When the top cover section 14 is mounted on the bottom section 12, the locking pins 72 of the lock section 16 are inserted within the access holes 54 of the top cover section 14. The lock section 16 is then pressed against the top cover section 14 so that the base 68 and the head 70 of the lock section fits within the indented portion 66 of the top cover section. Pressing the lock section 16 onto the top cover section 14 will cause the lock section locking pins 72 to extend through the locking pin access slots 36 of the bottom section 12. Thus, the locking pins 72 will occupy the space between the male insert 38 and the holding pins 40. Furthermore, the bending of the locking section 16 onto the top of the top cover section 14 will result in the locking section either bending or breaking from the top cover section 14 in the area of the notch 74.

Once fully assembled, the squib connector housing 10 may be connected to an airbag detonator receptacle by insertion of the male insert 38. When the male insert 38 is connected, male contact pins from the airbag detonator will extend within the first male pin receiving port 44 and the second male pin receiving port 46. The male contact pins will form an electrical connection with corresponding female contacts mounted within the bottom section 12. The connector housing is held within the detonator via the holding pins 40 which are maintained in their locked position via pressure of the locking pins 72 against the holding pins so that lip 50 remains engaged to the walls of the detonator. Use of the locking pins 72 and the head 70 requires a two-step process to secure the connector 10 to the detonator. The holding pins 40 must be inserted in one step and the locking pins 72 inserted in another step. Further, it may be seen that upon insertion of the connector to the receptacle, the lip 50 of the holding pin 40 fictionally engages the opening of the receptacle requiring a high insertion force of the connector into the receptacle. Accordingly, there is desired an electrical connector which may be mated to a receptacle and locked therein with a single step and a single motion, and with a low insertion force.

In view of the above, it is an object of the present invention to eliminate a secondary locking step in order to secure the connector to a receptacle.

Another object of the invention is to provide a connector which may be secured to a receptacle using a single insertion motion.

It is also an object of the invention to provide a connector having a locking mechanism which provides an insertion force less than the retention force of the mated connector.

SUMMARY OF THE INVENTION

In one form of the invention, an electrical connector comprising a main housing having contacts, latch members and deflector pins. A gap is provided between the locking members and the main housing for receiving a deflector pin which is slidingly received therein. Upon insertion of the deflector pin within the gap, the latch member is rotated outwardly to engage a lip of a receptacle and locking the connector therein. The locking members are in a resting position adjacent the sides of the housing which allow for the insertion of the connector in a receptacle with a low insertion force. The latch members are also moved to a locked position which is achieved upon movement of the deflector pin and provides for the locking of the connector within a receptacle.

A method of securing a connector within a receptacle is provided including the steps of inserting the connector into a receptacle having locking tabs in a resting position which allow for a low insertion force of the connector. Inserting a deflector pin in a gap adjacent the locking member rotating the locking member into a locked position. The method of securing the connector within the receptacle wherein the insertion force is less than the retaining force.

Various means for practicing the invention and other advantages and novel features thereof will be apparent from the following detailed description of an illustrative preferred embodiment of the invention.

BRIEF DESCRIPTION OF THE DRAWINGS

There is shown in the drawings a presently preferred embodiment of the present invention, wherein like numerals in the various figures pertain to like elements, and wherein.

DETAILED DESCRIPTION OF THE PRESENTLY PREFERRED EMBODIMENTS

Figure 1:
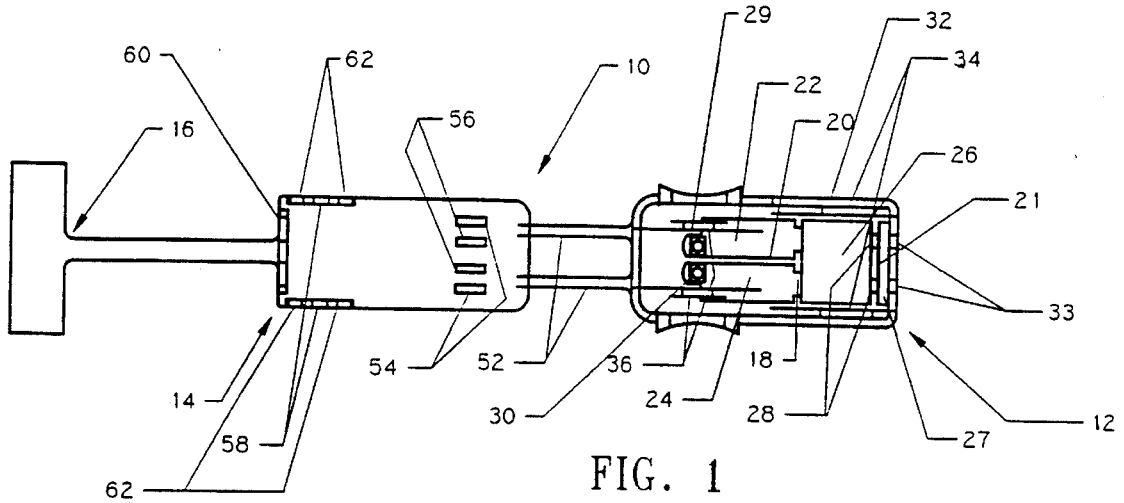
FIG. 1 is a bottom view of a connector housing of the prior art.
Figure 2:
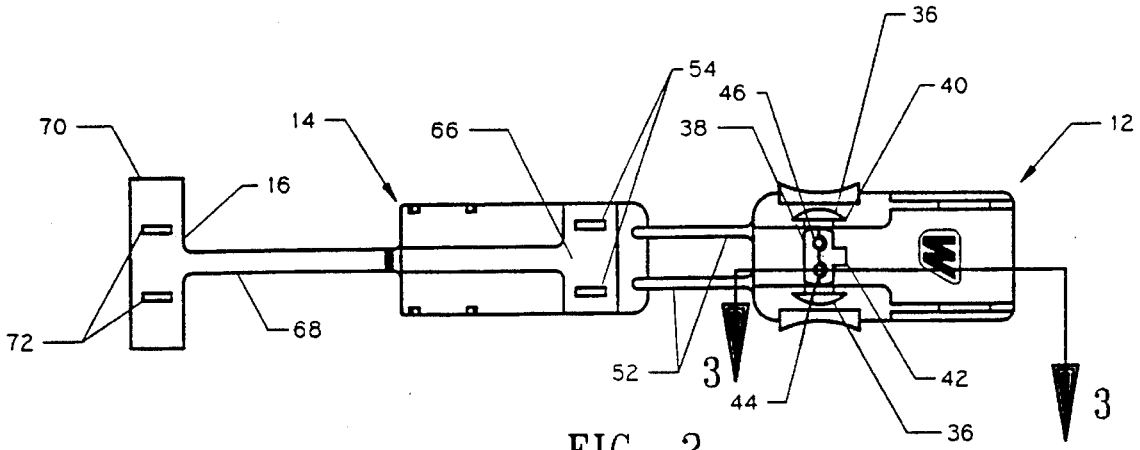
FIG. 2 is a cross-sectional side view of a connector housing of the prior art taken along line A—A of FIG. 1.
Figure 3:
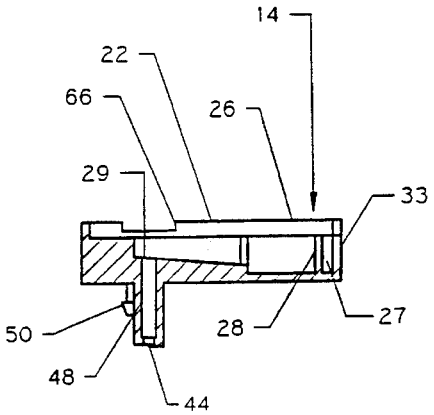
FIG. 3 is an end view of the molded a connector housing of the prior art.
Figure 4:
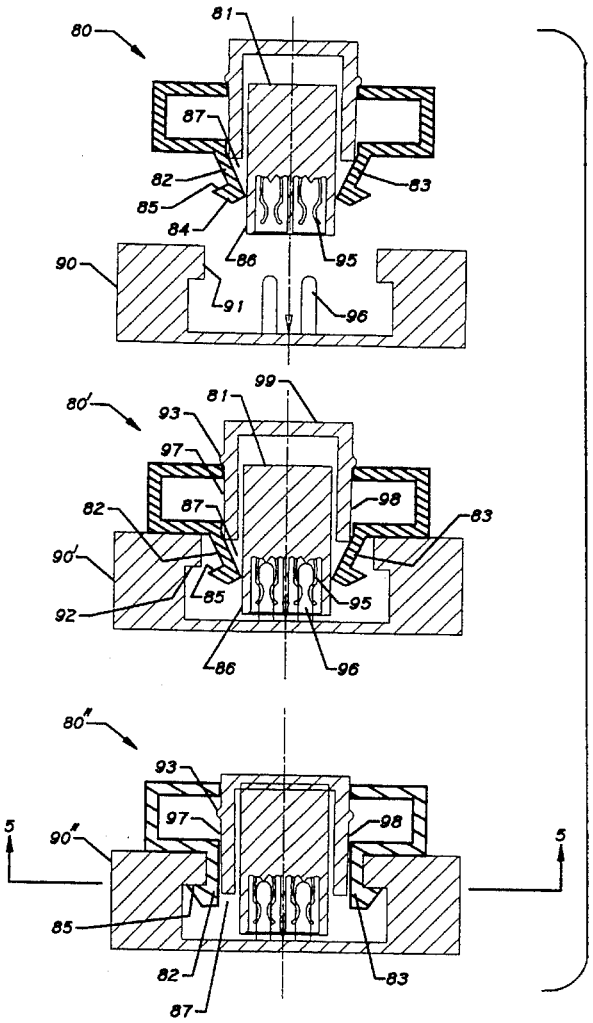
FIG. 4 is a series of drawings showing a side cut-away view of the insertion path of the present invention into a receptacle.
Figure 5:
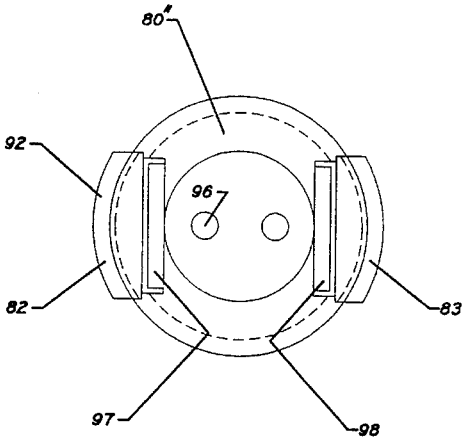
FIG. 5 is a partial bottom view of the connector of FIG. 4 taken at line 5—5.

Referring to FIGS. 4–5, a connector 80 includes a main housing 81 which in the top drawing is in its non-mated condition above the receptacle 90. The middle drawing shows the connector 80' inserted within receptacle 90'. In the bottom drawing, the connector 80" is shown inserted and locked within receptacle 90". Returning back to the top drawing and the connector 80, the main housing 81 includes locking members 82,83. The locking members 82,83 include a head 84 which includes a detente 85. The connector 80 includes the locking members 82,83 in their resting position with the head 84 adjacent the side walls 86 of the main housing 81. In a preferred embodiment, the main housing 81 and locking members 82,83 are injection molded of a polymer material and the locking members 82,83 are molded in the resting position adjacent the walls 86 of the main housing 81 of the connector 80. In the resting position of the locking members 82,83, a triangular-shaped gap 87 is formed between the wall 86 of the housing 81 and the locking members 82,83. Mounted within the main housing 81 are contacts 95. The contacts 95 of the connector 80 correspond to and mate with contact pins 96 of the receptacle 90. In a preferred embodiment, the receptacle 90 is an automobile airbag inflation canister or detonator.

It may be seen that the orientation of the latch members 82,83 in their resting position provides for detentes 85 so that the width of the connector 80 at the detentes 85 is less than the width of the receptacle opening 91. Therefore, upon insertion of the connector 80 within receptacle 90, the detentes easily slide past opening 91 for insertion of the connector 80 therein and electrical connection of contacts 95 and 96. As the resting position of the latch members 82,83 is adjacent the housing 81, a low insertion force is needed to insert the connector 80 in the receptacle 90.

Turning to the middle drawing where the connector 80' is inserted, but not locked within receptacle 90', it may be seen that contact pins 96 of the receptacle 90' are mated to and electrically connected with contacts 95 of the connector 80'. In the intermediate position, the latch members 82,83 are still in their resting position, so that the connector 80' is not secured within the receptacle 90', as the detentes 85 are still canted away from the lip 92 of the receptacle 90'. Although there is a friction fit achieved by the contacts 95 and the contact pins 96, the retention force is insufficient to meet connector latch requirements for the fail-proof automobile airbag system. In a preferred embodiment, a retention force of at least thirty pounds is required.

A deflector pin 97,98 is also provided on the connector 80'. In a preferred embodiment, a pair of deflector pins 97,98 are attached via a top member 99. The deflector pins 97,98 are shown in an open position wherein gap 87 is still present between the locking members 82,83 and the walls 86 of the housing 81. The deflector pins 97,98 are retained in their open position by protrusions 93 which are molded on the outer edge of the deflector pins 97,98 and engage the housing top.

Turning to the bottom drawing of FIG. 4, the connector 80" is shown inserted and locked within receptacle 90". The deflector pins 97,98 have been moved to a closed position wherein the deflector pins 97,98 have been slid down into the gap 87 causing the latch members 82,83 to deflect so that detent 85 is moved to engage lip 92 of the receptacle 90". It can be seen that the deflector pins 97,98 have been moved to the closed position in that the protrusion 93 has moved below and inside of the connector 80". By the latching of latch members 82,83 the connector 80" is secured within the receptacle in a preferred embodiment so that a retention force of greater than thirty pounds is provided by the latch members 82,83.

Turning to FIG. 5, a bottom cut-away view of FIG. 4 is taken at line 5—5. The receptacle 90" has inserted therein the connector 80" having latch members 82,83 latched over lip 92 and maintained in their deflected position by deflector pins 97,98.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An electrical connector comprising:

a housing having contacts therein and a locking member in a resting position adjacent said housing forming a gap; a deflector pin coupled and slidable on said housing and insertable within the gap wherein the electrical connector with the locking member in said resting position is received within a receptable and is moved from said resting position to a locked position by sliding the pin within the gap between the locking member and the housing for engaging the locking member with a lip of the receptacle to secure the connector within the receptacle.

2. The electrical connector of claim 1 wherein said locking member includes a detente for engaging said lip of said receptacle.

3. The electrical connector of claim 1 wherein said housing includes a pair of locking members and a pair of deflector pins.

4. The electrical connector of claim 1 wherein said locking member in said resting position provides a width of the housing at the locking member is less than the width of the opening of said receptacle.

5. An electrical connector of claim 1 wherein a pair of deflector pins are connected by a top member being slidingly retained within said housing.

6. The electrical connector of claim 5 wherein said deflector pins include a protrusion for maintaining said deflector pins in an open position and upon insertion of said deflector pins within said housing, moving said deflector pins into a closed position and deflecting said locking member.

7. The electrical connector of claim 1 wherein said locking members are in a locked position providing for a retention force of thirty pounds or greater.

8. A method of retaining an electrical connector in a receptacle including the steps of:

inserting a connector into a receptacle having locking tabs in a resting position which provides for a low insertion force of the connector;

inserting a deflector pin coupled and slidable on said connector in a gap adjacent the locking tab after the connector is received within the receptacle for causing the locking tab to rotate into a locked position to retain the connector within the receptacle.

9. The method of claim 8 wherein the insertion force is less than the retaining force.

* * * * *